US008897690B2

(12) United States Patent
Sakon et al.

(10) Patent No.: US 8,897,690 B2
(45) Date of Patent: Nov. 25, 2014

(54) CLEANING BLADE, IMAGE FORMING APPARATUS AND PROCESS CARTRIDGE

(71) Applicants: Yohta Sakon, Kanagawa (JP); Masahiro Ohmori, Kanagawa (JP); Yuka Aoyama, Kanagawa (JP); Shinji Nohsho, Tokyo (JP); Yasuyuki Yamashita, Kanagawa (JP); Masanobu Gondoh, Kanagawa (JP); Shohei Gohda, Kanagawa (JP)

(72) Inventors: Yohta Sakon, Kanagawa (JP); Masahiro Ohmori, Kanagawa (JP); Yuka Aoyama, Kanagawa (JP); Shinji Nohsho, Tokyo (JP); Yasuyuki Yamashita, Kanagawa (JP); Masanobu Gondoh, Kanagawa (JP); Shohei Gohda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 18 days.

(21) Appl. No.: 13/764,968

(22) Filed: Feb. 12, 2013

(65) Prior Publication Data

US 2013/0243507 A1 Sep. 19, 2013

(30) Foreign Application Priority Data

Mar. 15, 2012 (JP) ..... 2012-058924
Dec. 18, 2012 (JP) ..... 2012-275851

(51) Int. Cl.
*G03G 21/00* (2006.01)

(52) U.S. Cl.
CPC .... *G03G 21/0017* (2013.01); *G03G 2215/0132* (2013.01)
USPC ..... 399/350; 15/256.5

(58) Field of Classification Search
USPC ..... 399/350, 101, 343; 15/256.5, 256.51, 15/256.52
See application file for complete search history.

(56) References Cited

U.S. PATENT DOCUMENTS

| | | | | |
|---|---|---|---|---|
| 2009/0311017 | A1* | 12/2009 | Ohmori et al. | 399/350 |
| 2011/0135361 | A1 | 6/2011 | Kabata et al. | |
| 2011/0217102 | A1* | 9/2011 | Ohmori et al. | 399/350 |
| 2012/0183792 | A1* | 7/2012 | Mizuno et al. | 428/458 |

FOREIGN PATENT DOCUMENTS

| | | |
|---|---|---|
| JP | 9-127846 | 5/1997 |
| JP | 2004-191639 | 7/2004 |
| JP | 2004-233818 | 8/2004 |
| JP | 2009-223071 | 10/2009 |
| JP | 2010-152295 | 7/2010 |

OTHER PUBLICATIONS

European Search Report dated May 9, 2014 in corresponding European patent application No. 13 15 6934.5.

* cited by examiner

*Primary Examiner* — Sophia S Chen
(74) *Attorney, Agent, or Firm* — Cooper & Dunham LLP

(57) ABSTRACT

A cleaning blade, including a strip-shaped elastic blade to contact the surface of a member to be cleaned, traveling on an edge line of the elastic blade, to remove a powder from the surface thereof, wherein the edge line of the elastic blade is impregnated with an ultraviolet curable resin including a fluorinated acrylic monomer, a surface layer harder than the elastic blade is formed on each of an under surface thereof, having the edge line as one line of the under surface and facing the member, and an apical surface thereof, having the edge line as one line of the apical surface and being parallel to a direction of the thickness thereof, and the apical surface is impregnated with the ultraviolet curable resin at a depth of from 50 to 150 μm and the under surface is impregnated therewith at a depth of from 20 to 100 μm.

12 Claims, 6 Drawing Sheets

PROJECTED IMAGE OF PARTICLE PERIPHERAL LENGTH: C1

AREA: S

CIRCLE WITH AREA OF S PERIPHERAL LENGTH: C2

AREA: S

CLEANING BLADE, IMAGE FORMING APPARATUS AND PROCESS CARTRIDGE

CROSS-REFERENCE TO RELATED APPLICATIONS

This patent application is based on and claims priority pursuant to 35 U.S.C. §119 to Japanese Patent Applications Nos. 2012-058924 and 2012-275851, filed on Mar. 15, 2012 and Dec. 18, 2012, respectively, in the Japan Patent Office, the entire disclosure of which is hereby incorporated by reference herein.

BACKGROUND OF THE INVENTION

1. Field of the Invention

The present invention relates to a cleaning blade, an image forming apparatus and a process cartridge.

2. Description of the Related Art

In electrophotographic image forming apparatuses, residual toner remaining on the surface of a photoreceptor even after a toner image thereon is transferred onto a recording material or an intermediate transfer medium is removed therefrom using a cleaner.

Strip-shaped cleaning blades made of an elastic material such as polyurethane rubbers are typically used for such a cleaner because of having advantages such that the cleaner has simplified structure and good cleanability. Among such cleaning blades, a cleaning blade in which one end thereof is supported by a supporter, and an edge of the other end is contacted with a surface of a photoreceptor to block and scrape off residual toner on the photoreceptor, thereby removing the residual toner from the surface of the photoreceptor.

In attempting to meet a recent need of forming high quality images, there are image forming apparatuses using spherical toner (hereinafter referred to as polymerization toner), which has a relatively small particle diameter and which is prepared by a method such as polymerization methods. Since such polymerization toner has such an advantage as to have higher transfer efficiency than pulverization toner, which has been conventionally used, the polymerization toner can meet the need. However, polymerization toner has such a drawback as not to be easily removed from a photoreceptor by a cleaning blade. This is because such polymerization toner has a spherical form and a small particle diameter, and easily passes through a small gap between the tip of a cleaning blade and the surface of a photoreceptor.

In attempting to prevent polymerization toner from passing through a gap between a cleaning blade and a photoreceptor, it is necessary to increase the pressure to the cleaning blade contacted with the surface of the photoreceptor to enhance the cleanability of the cleaning blade.

However, as disclosed in Japanese published unexamined application No. JP-2010-152295-A, when the contact pressure of the cleaning blade is increased, the friction between the cleaning blade and the photoreceptor is increased, and thereby the tip of the cleaning blade is pulled by the photoreceptor in the moving direction of the photoreceptor. Specifically, as illustrated in FIG. 8(*a*), a cleaning blade 62 is pulled by the surface of an photoreceptor 123 in a moving direction (indicated by an arrow) of the photoreceptor due to increase of friction between the blade and the photoreceptor, thereby causing a problem (hereinafter referred to as everted-tip problem) in that an edge line 62*c* of an apical surface 62*a* of the blade 62 is everted. In this regard, the thus everted tip has a restoring force, and therefore the tip tends to vibrate, resulting in generation of fluttering sounds. In addition, when the cleaning operation is continued while the edge line 62*c* of the cleaning blade 62 is everted, a portion of the apical surface 62*a* of the cleaning blade 62, which is apart from the edge line 62*c* by few micrometers, is abraded as illustrated in FIG. 8(*b*). When the cleaning blade 62 is further used for the cleaning operation, the portion of the apical surface 62*a* of the blade 62 is further abraded, resulting in lack of the edge line 62*c* of the blade 62 as illustrated in FIG. 8(*c*). The cleaning blade 62 having no edge line cannot remove residual toner from the surface of the photoreceptor 123, thereby forming an abnormal image in which background thereof is soiled with residual toner.

Japanese published unexamined application No. JP-2010-152295-A discloses a cleaning blade formed of a low-friction elastic blade, the edge line of which is impregnated with at least one of an isocyanate compound, a fluorine compound and a silicone compound; and a surface layer covering an edge line of the elastic blade, formed of a UV curing resin harder than the elastic blade.

The cleaning blade having an edge line a surface layer harder than the elastic blade is formed on can prevent the edge line from deforming in a travel direction of a photoreceptor. Further, even when the surface layer is worn out and an edge line of the elastic blade is exposed, the impregnated part thereof contacts the photoreceptor and a frictional force between the elastic blade and the photoreceptor is reduced to prevent the exposed part from deforming. This prevents the edge line from being everted and increases abrasion resistance of the cleaning blade to prevent poor cleaning.

Because of these reasons, a need exist for a cleaning blade preventing poor cleaning while having higher abrasion resistance than that disclosed in Japanese published unexamined application No. IP-2010-152295-A.

SUMMARY OF THE INVENTION

Accordingly, one object of the present invention to provide a cleaning blade preventing poor cleaning while having higher abrasion resistance than that disclosed in Japanese published unexamined application No. JP-2010-152295-A.

Another object of the present invention to provide an image forming apparatus using the cleaning blade.

A further object of the present invention to provide a process cartridge using the cleaning blade.

These objects and other objects of the present invention, either individually or collectively, have been satisfied by the discovery of a cleaning blade, comprising a strip-shaped elastic blade configured to contact the surface of a member to be cleaned, traveling on an edge line of the elastic blade, to remove a powder from the surface of the member to be cleaned, wherein the edge line of the elastic blade is impregnated with an ultraviolet curable resin comprising a fluorinated acrylic monomer, a surface layer harder than the elastic blade is formed on each of an under surface thereof, having the edge line as one line of the undersurface and facing the member to be cleaned, and an apical surface thereof, having the edge line as one line of the apical surface and being parallel to a direction of the thickness thereof, and the apical surface is impregnated with the ultraviolet curable resin at a depth of from 50 to 150 μm and the under surface is impregnated with the ultraviolet curable resin at a depth of from 20 to 100 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a cleaning blade preventing poor cleaning while having higher abrasion resistance than that disclosed in Japanese published unexamined application No JP-2010-152295-A.

More particularly, the present invention relates to a cleaning blade, comprising a strip-shaped elastic blade configured to contact the surface of a member to be cleaned, traveling on an edge line of the elastic blade, to remove a powder from the surface of the member to be cleaned, wherein the edge line of the elastic blade is impregnated with an ultraviolet curable resin comprising a fluorinated acrylic monomer, a surface layer harder than the elastic blade is formed on each of an under surface thereof, having the edge line as one line of the undersurface and facing the member to be cleaned, and an apical surface thereof, having the edge line as one line of the apical surface and being parallel to a direction of the thickness thereof, and the apical surface is impregnated with the ultraviolet curable resin at a depth of from 50 to 150 μm and the under surface is impregnated with the ultraviolet curable resin at a depth of from 20 to 100 μm.

Figure 2:
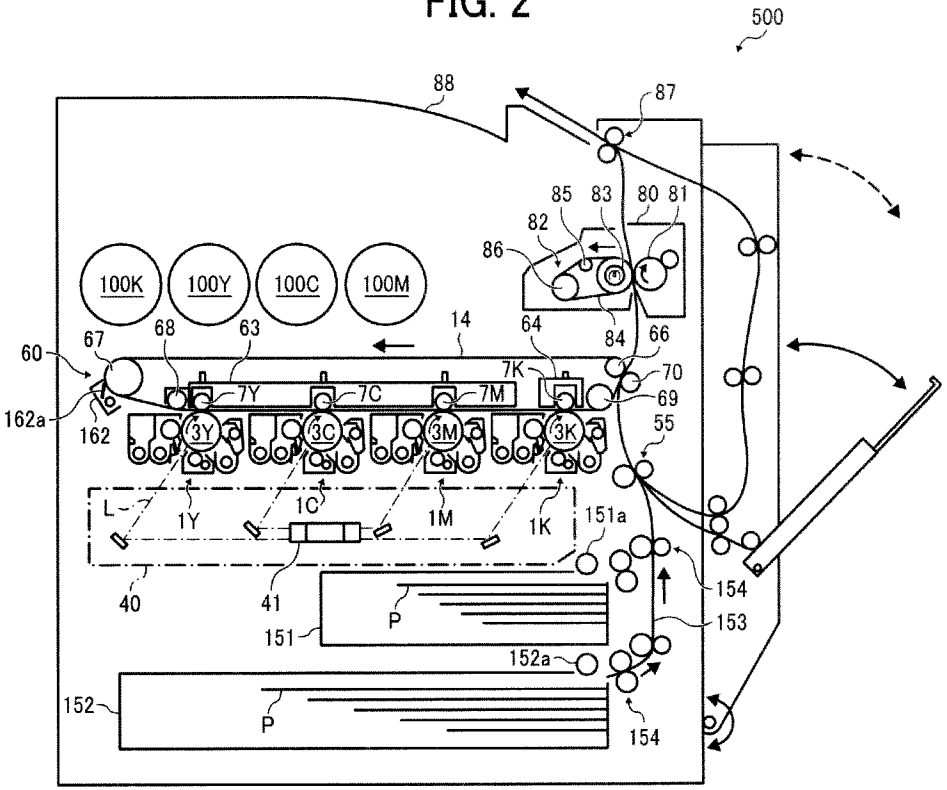
FIG. 2 is a schematic cross-sectional view illustrating an example of the image forming apparatus of this disclosure.

Initially, an example of the image forming apparatus of this disclosure will be described by reference to drawings. FIG. 2 illustrates an electrophotographic printer as an example of the image forming apparatus of this disclosure.

Referring to FIG. 2, a printer 500 includes four image forming units, i.e., yellow (Y), cyan (C), magenta (M) and black (K) image forming units 1Y, 1C, 1M and 1K. The four image forming units 1Y, 1C, 1M and 1K have the same configuration except that the color of toner used for developing an electrostatic latent image on a photoreceptor is different.

The printer 500 further includes a transfer unit 60, which includes an intermediate transfer belt 14 and which is located above the four image forming units 1. As mentioned later in detail, Y, C, M and K toner images formed on respective photoreceptors 3Y, 3C, 3M and 3K serving as photoreceptors are transferred onto the surface of the intermediate transfer belt 14 so as to be overlaid, resulting in formation of a combined color toner image on the intermediate transfer belt 14.

In addition, an optical writing unit 40 serving as a latent image former is located below the four image forming units 1. The optical writing unit 40 emits light beams L (such as laser beams) based on Y, C, M and K image information to irradiate the photoreceptors 3Y, 3C, 3M and 3K with the laser beams L, thereby forming electrostatic latent images, which respectively correspond to the Y, C, M and K images to be formed, on the photoreceptors. The optical writing unit 40 includes a polygon mirror 41, which is rotated by a motor and which reflects the light beams L emitted by a light source of the optical writing unit while deflecting the laser beams to irradiate the photoreceptors 3Y, 3C, 3M and 3K with the laser beams L via optical lenses and mirrors. The optical writing unit 40 is not limited thereto, and an optical writing unit using a LED array or the like can also be used therefor.

Below the optical writing unit 40, a first sheet cassette 151, and a second sheet cassette 152 are arranged so that the first sheet cassette is located above the second sheet cassette. Each of the sheet cassettes 151 and 152 contains a stack of paper sheets P serving as a recording material. Uppermost sheets of the paper sheets P in the first and second sheet cassettes 151 and 152 are contacted with a first feed roller 151*a* and a second feed roller 152*a*, respectively. When the first feed roller 151*a* is rotated (counterclockwise in FIG. 2) by a driver (not shown), the uppermost sheet P in the first sheet cassette 151 is fed by the first feed roller 151*a* toward a sheet passage 153 located on the right side of the printer 500 while extending vertically. Similarly, when the second feed roller 152*a* is rotated (counterclockwise in FIG. 2) by a driver (not shown), the uppermost sheet P in the second sheet cassette 152 is fed by the second feed roller 152*a* toward the sheet passage 153.

Plural pairs of feed rollers 154 are arranged in the sheet passage 153. The paper sheet P fed into the sheet passage 153 is fed from the lower side of the sheet passage 153 to the upper side thereof while being pinched by the pairs of feed rollers 154.

A pair of registration rollers 55 is arranged on the downstream side of the sheet passage 153 relative to the sheet feeding direction. When the pair of registration rollers 55 pinches the tip of the paper sheet P thus fed by the pairs of feed rollers 154, the pair of registration rollers 55 is stopped once, and is then rotated again to timely feed the paper sheet P to a secondary transfer nip mentioned below so that a combined color toner image on the intermediate transfer belt 14 is transferred onto the predetermined position of the paper sheet P.

Figure 3:
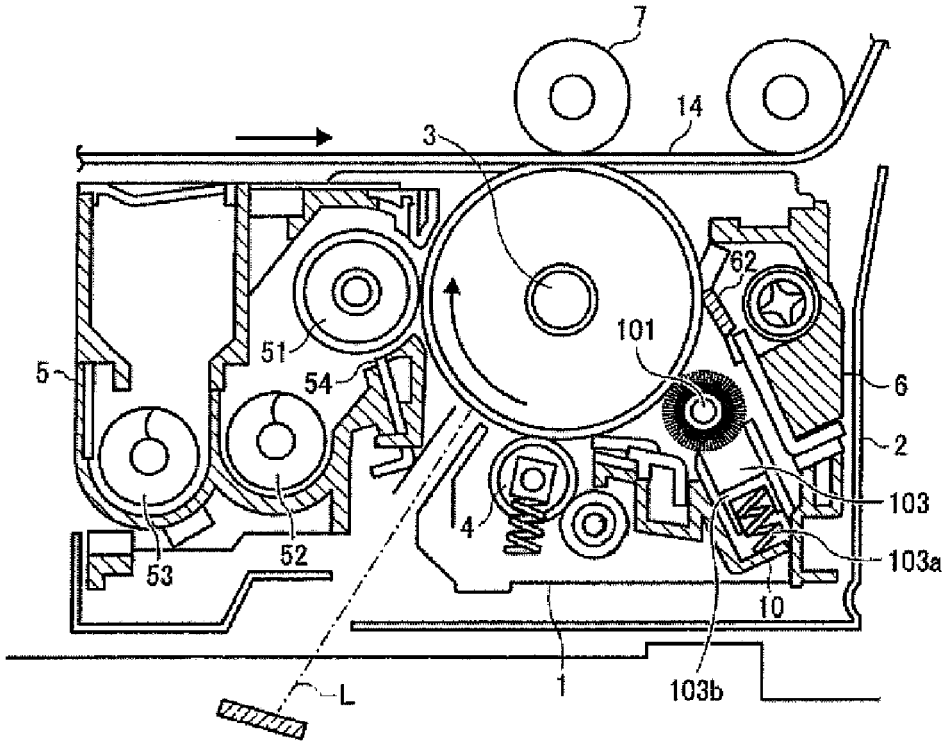
FIG. 3 is a schematic cross-sectional view illustrating an image forming unit of the image forming apparatus illustrated in FIG. 2.

FIG. 3 illustrates one of the four image forming units 1.

As illustrated in FIG. 3, the image forming unit 1 includes a drum-shaped photoreceptor 3 serving as a photoreceptor. The shape of the photoreceptor 3 is not limited thereto, and sheet-shaped photoreceptors, endless belt-shaped photoreceptors and the like can also be used.

Around the photoreceptor 3, a charging roller 4, an image developer 5, a primary transfer roller 7, a cleaner 6, a lubricant applicator 10, a discharging lamp (not shown), etc., are arranged. The charging roller 4 serves as a charger for charging a surface of the photoreceptor 3. The image developer 5 serves as an image developer for developing an electrostatic latent image formed on the photoreceptor 3 with a developer to form a toner image thereon. The primary transfer roller 7 serves as a primary transferer for transferring the toner image on the photoreceptor 3 to the intermediate transfer belt 14. The cleaner 6 serves as a cleaner for removing residual toner from the surface of the photoreceptor 3 after transferring the toner image. The lubricant applicator 10 serves as a lubricant applicator for applying a lubricant to the surface of the photoreceptor 3 after cleaning the surface. The discharging lamp (not shown) serves as a discharger for decaying residual charges remaining on the surface of the photoreceptor 3 after cleaning the surface.

The charging roller 4 is arranged in the vicinity of the photoreceptor 3 with a predetermined gap therebetween, and evenly charges the photoreceptor 3 so that the photoreceptor 3 has a predetermined potential with a predetermined polarity. The thus evenly charged surface of the photoreceptor 3 is irradiated with the light beam L emitted by the optical writing unit 40 based on image information, thereby forming an electrostatic latent image on the surface of the photoreceptor 3.

The image developer 5 has a developing roller 51 serving as a developer bearing member. A development bias is applied to the developing roller 51 by a power source (not shown). A supplying screw 52 and an agitating screw 53 are provided in a casing of the image developer 5 to feed the developer in opposite directions in the casing so that the developer is charged so as to have a charge with a predetermined polarity. In addition, a doctor 54 is provided in the image developer to form a developer layer having a predetermined thickness on the surface of the developing roller 51. The layer of the developer, which has been charged so as to have a charge with the predetermined polarity, is adhered to an electrostatic latent image on the photoreceptor 3 at a development region, in which the developing roller 51 is opposed to the photoreceptor 3, resulting in formation of a toner image on the surface of the photoreceptor 3.

The cleaner 6 includes a fur brush 101, the cleaning blade 62, etc. The cleaning blade 62 is contacted with the surface of the photoreceptor 3 in such a manner as to counter the rotated photoreceptor 3. The cleaning blade 62 will be described later in detail.

The lubricant applicator 10 includes a solid lubricant 103, and a pressing spring 103*a* to press the solid lubricant 103 toward the fur brush 101 serving as a lubricant applicator to apply the lubricant to the surface of the photoreceptor 3. The solid lubricant 103 is supported by a bracket 103*b* while being pressed toward the fur brush 101 by the pressing spring 103*a*. The solid lubricant 103 is scraped by the fur brush 101, which is driven by the photoreceptor 3 so as to rotate (counterclockwise in FIG. 3), thereby applying the lubricant 103 to the surface of the photoreceptor 3. By thus applying the lubricant, the friction coefficient of the surface of the photoreceptor 3 can be controlled so as to be not higher than 0.2

Although non-contact short-range charging roller 4 is used as the charger of the image forming unit 1, the charger is not limited thereto, and contact chargers (such as contact charging rollers), corotrons, scorotrons, solid state chargers, and the like can also be used for the charger. Among these chargers, contact chargers, and non-contact short-range chargers are preferable because of having advantages such that the charging efficiency is high, the amount of ozone generated in a charging operation is small, and the charger can be miniaturized.

Specific examples of light sources for use in the optical writing unit 40 and the discharging lamp include any known light emitters such as fluorescent lamps, tungsten lamps, halogen lamps, mercury lamps, sodium lamps, light emitting diodes (LEDs), laser diodes (LDs), electroluminescent lamps (ELs), and the like.

In order to irradiate the photoreceptor 3 with light having a wavelength in a desired range, sharp cut filters, bandpass filters, infrared cut filers, dichroic filters, interference filters, color temperature converting filters, and the like can be used.

Among these light sources, LEDs and LDs are preferably used because of having advantages such that the irradiation energy is high, and light having a relatively long wavelength of from 600 to 800 nm can be emitted.

The transfer unit 60 serving as a transferor includes not only the intermediate transfer belt 14, but also a belt cleaning unit 162, a first bracket 63, and a second bracket 64. In addition, the transfer units 60 further includes four primary transfer rollers 7Y, 7C, 7M and 7K, a secondary transfer backup roller 66, a driving roller 67, a supplementary roller 68, and a tension roller 69. The intermediate transfer belt 14 is rotated counterclockwise in an endless manner by the driving roller 67 while being tightly stretched by the four rollers. The four primary transfer rollers 7Y, 7C, 7M and 7K press the thus rotated intermediate transfer belt 14 toward the photoreceptors 3Y, 3C, 3M and 3K, respectively, to form four primary transfer nips. In addition, a transfer bias having a polarity opposite that of the charge of the toner is applied to the backside (i.e., inner surface) of the intermediate transfer belt (for example, a positive bias is applied when a negative toner is used). Since the intermediate transfer belt 14 is rotated endlessly, yellow, cyan, magenta and black toner images, which are formed on the photoreceptors 3Y, 3C, 3M and 3K, respectively, are sequentially transferred onto the intermediate transfer belt 14 so as to be overlaid, resulting in formation of a combined color toner image on the intermediate transfer belt 14.

The secondary transfer backup roller 66 and a secondary transfer roller 70 sandwich the intermediate transfer belt 14 to form a secondary transfer nip. As mentioned above, the pair of registration rollers 55 pinches the transfer paper sheet P once, and then timely feeds the paper sheet P toward the secondary transfer nip so that the combined color toner image on the intermediate transfer belt 14 is transferred onto a predetermined position of the paper sheet P. Specifically, the entire combined color toner image is transferred due to a secondary transfer electric field formed by the secondary transfer roller 70, to which a secondary transfer bias is applied, and the secondary transfer backup roller 66, and a nip pressure applied between the secondary transfer roller 70 and the transfer backup roller 66, resulting in formation of a full color toner image on the paper sheet P having white color.

After passing the secondary transfer nip, the intermediate transfer belt 14 bears residual toners (i.e., non-transferred toners) on the surface thereof. The belt cleaning unit 162 removes the residual toners from the surface of the intermediate transfer belt 14. Specifically, a belt cleaning blade 162*a* of the belt cleaning unit 162 is contacted with the surface of the intermediate transfer belt 14 to remove the residual toners therefrom.

The first bracket 63 of the transfer unit 60 is rotated at a predetermined rotation angle on a rotation axis of the supplementary roller 68 by being driven by an on/off operation of a solenoid (not shown). When a monochromatic image is formed, the printer 500 slightly rotates the first bracket 63 counterclockwise by driving the solenoid. When the first bracket 63 is thus rotated, the primary transfer rollers 7Y, 7C and 7M are moved counterclockwise around the rotation axis of the supplementary roller 68, thereby separating the intermediate transfer belt 14 from the photoreceptors 3Y, 3C and 3M. Thus, only the black image forming unit 1K is operated (without driving the color image forming units 1Y, 1C and 1M) to form a monochromatic image. By using this method, the life of the parts of the color image forming units 1Y, 1C and 1M can be prolonged.

As illustrated in FIG. 2, a fixing unit 80 is provided above the secondary transfer nip. The fixing unit 80 includes a pressure/heat roller 81 having a heat source (such as a halogen lamp) therein, and a fixing belt unit 82. The fixing belt unit 82 includes an endless fixing belt 84 serving as a fixing member, a heat roller 83 having a heat source (such as a halogen lamp) therein, a tension roller 85, a driving roller 86, a temperature sensor (not shown), and the like. The endless fixing belt 84 is counterclockwise rotated endlessly by the driving roller 86 while being tightly stretched by the heat roller 83, the tension roller 85 and the driving roller 86. When the fixing belt 84 is rotated, the fixing belt is heated by the heat roller 83 from the backside thereof. The pressure/heat roller 81 is contacted with the front surface of the fixing belt 84 while pressing the fixing belt 84 to the heat roller 83, resulting in formation of a fixing nip between the pressure/heat roller 81 and the fixing belt 84.

A temperature sensor (not shown) is provided so as to be opposed to the front surface of the fixing belt 84 with a predetermined gap therebetween to detect the temperature of the fixing belt 84 at a location just before the fixing nip. The detection data are sent to a fixing device supply circuit (not shown). The fixing device supply circuit performs ON/OFF control on the heat source in the heat roller 83 and the heat source in the pressure/heat roller 81.

The transfer paper sheet P passing the secondary transfer nip and separated from the intermediate transfer belt 14 is fed to the fixing unit 80. When the paper sheet P bearing the unfixed full color toner image thereon is fed from the lower side of the fixing unit 80 to the upper side thereof while being sandwiched by the fixing belt 14 and the pressure/heat roller 81, the paper sheet P is heated by the fixing belt 84 while being pressed by the pressure/heat roller 81, resulting in fixation of the full color toner image on the paper sheet P.

The paper sheet P thus subjected to a fixing treatment is discharged from the main body of the printer 500 by a pair of discharging rollers 87 so as to be stacked on a surface of a stacking portion 88.

Four toner cartridges 100Y, 100C, 100M and 100K respectively containing yellow, cyan, magenta and black color toners are provided above the transfer unit 60 to supply the yellow, cyan, magenta and black color toners to the corresponding image developers 5Y, 5C, 5M and 5K of the image forming units 1Y, 1C, 1M and 1K, if desired. These toner cartridges 100Y, 100C, 100M and 100K are detachable from the main body of the printer 500 independently of the image forming units 1Y, 1C, 1M and 1K.

Next, the image forming operation of the printer 500 will be described.

Upon receipt of a prim execution signal from an operating portion (not shown) such as an operation panel, predetermined voltages or currents are applied to the charging roller 4 and the developing roller 51 at predetermined times. Similarly, predetermined voltages or currents are applied to the light sources of the optical writing unit 40 and the discharging lamp. In synchronization with these operations, the photoreceptors 3 are rotated in a direction indicated by an arrow by a driving motor (not shown).

When the photoreceptors 3 are rotated, the surfaces thereof are charged by the respective charging rollers 4 so as to have predetermined potentials. Next, light beams L (such as laser beams) emitted by the optical writing unit 40 irradiate the charged surfaces of the photoreceptors 3, thereby forming electrostatic latent images on the surface of the photoreceptors 3.

The surfaces of the photoreceptors 3 bearing the electrostatic latent images are rubbed by magnetic brushes of the respective developers formed on the respective developing rollers 51. In this case, the (negatively-charged) toners on the developing rollers 51 are moved toward the electrostatic latent images by the development biases applied to the developing rollers 51, resulting in formation of color toner images on the surface of the photoreceptors 3Y, 3C, 3M and 3K.

Thus, each of the electrostatic latent images formed on the photoreceptors 3 is subjected to a reverse development treatment using a negative toner. In this example, an N/P (negative/positive: a toner adheres to a place having lower potential) developing method using a non-contact charging roller is used, but the developing method is not limited thereto.

The color toner images formed on the surfaces of the photoreceptors 3Y, 3C, 3M and 3K are primarily transferred to the intermediate transfer belt 14 so as to be overlaid, thereby forming a combined color toner image on the intermediate transfer belt 14. The combined color toner image thus formed on the intermediate transfer belt 14 is transferred onto a predetermined portion of the paper sheet P, which is fed from the first or second cassette 151 or 152 and which is timely fed to the secondary transfer nip by the pair of registration rollers 55 after being pinched thereby. After the paper sheet P bearing the combined color toner image thereon is separated from the intermediate transfer belt 14, the paper sheet P is fed to the fixing unit 80. When the paper sheet P hearing the combined color toner image thereon passes the fixing unit 80, the combined toner image is fixed to the paper sheet P upon application of heat and pressure thereto. The paper sheet P bearing the fixed combined color toner image (i.e., a full color image) thereon is discharged from the main body of the printer 500, resulting in stacking on the surface of the stacking portion 88.

Toners remaining on the surface of the intermediate transfer belt 14 even after the combined color toner image thereon is transferred to the paper sheet P are removed therefrom by the belt cleaning unit 162.

Toners remaining on the surfaces of the photoreceptors 3 even after the color toner images thereon is transferred to the intermediate transfer belt 14 are removed therefrom by the cleaner 6. Further, the surfaces of the photoreceptors 3 are coated with a lubricant by the lubricant applicator 10, followed by a discharging treatment using a discharging lamp.

As illustrated in FIG. 3, the photoreceptor 3, the charging roller 4, the developing device 5, the cleaner 6, the lubricant applicator 10, and the like are contained in a case 2 of the image forming unit 1 of the printer 500. The image forming unit 1 is detachable attachable to the main body of the printer 500 as a single unit (i.e., process cartridge). However, the image forming unit 1 is not limited thereto, and may have a configuration such that each of the members and devices such as the photoreceptor 3, charging roller 4, developing device 5, cleaner 6, and lubricant applicator 10 is replaced with a new member or device.

Next, the toner for use in the printer 500 (i.e., the image forming apparatus of the present invention) will be described.

The toner is preferably a toner having a high circularity and a small particle diameter. Such a toner can be preferably prepared by polymerization methods such as suspension polymerization methods, emulsion polymerization methods, dispersion polymerization methods, and the like. The toner preferably has an average circularity not less than 0.97, and a volume-average particle diameter not greater than 5.5 μm to produce high resolution toner images.

The average circularity of the toner is measured using a flow particle image analyzer FPIA-2000 from Sysmex Corp. The procedure is as follows:

(1) initially, 100 to 150 ml of water, from which solid foreign materials have been removed, 0.1 to 0.5 ml of a surfactant (e.g., alkylbenzenesulfonate) and 0.1 to 0.5 g of a sample (i.e., toner) are mixed to prepare a dispersion;
(2) the dispersion is further subjected to a supersonic dispersion treatment for 1 to 3 minutes using a supersonic dispersion machine to prepare a dispersion including particles at a concentration of from 3,000 to 10,000 pieces/pi;
(3) the dispersion set in the analyzer so as to be passed through a detection area formed on a plate in the analyzer; and
(4) the particles of the sample passing through the detection area are optically detected by a CCD camera and then the shapes of the toner particles and the distribution of the shapes are analyzed with an image analyzer to determine the average circularity of the sample.

Figure 4A:
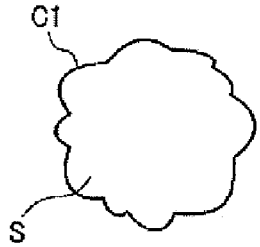
FIGS. 4A and 4B are schematic views for explaining the way to determine the circularity of toner.
Figure 4B:
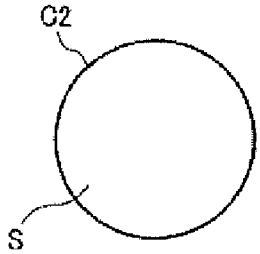

The method for determining the circularity of a particle will be described by reference to FIGS. 4A and 4B. When the projected image of a particle has a peripheral length C1 and an area S as illustrated in FIG. 4A, and the peripheral length of the circle having the same area S is C2 as illustrated in FIG. 4B, the circularity of the particle is obtained by the following equation.

$$\text{Circularity}=C2/C1$$

The average circularity of the toner is obtained by averaging circularities of particles.

The volume-average particle diameter of toner can be measured, for example, by an instrument such as COULTER MULTISIZER 2e manufactured by Beckman Coulter Inc. Specifically, the number-based particle diameter distribution data and the volume-based particle diameter distribution data are sent to a personal computer via an interface manufactured by Nikkaki Bios Co., Ltd, to be analyzed. The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl;
(2) 2 to 20 mg of a sample (toner) to be measured is added into the mixture;
(3) the mixture is subjected to an ultrasonic dispersion treatment for about 1 to 3 minutes; and
(4) the dispersion is added to 100 to 200 ml of an aqueous solution of an electrolyte in a beaker so that the mixture includes the particles at a predetermined concentration;
(5) the diluted dispersion is set in the instrument to measure particle diameters of 50,000 particles using an aperture of 100 μm to determine the volume average particle diameter.

In this regard, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 to 40.30 μm are targeted.

In this regard, the volume average particle diameter is obtained by the following equation.

$$\text{Volume average particle diameter}=\Sigma fV/\Sigma fV,$$

wherein X represent the representative particle diameter of each channel, V represents the volume of the particle having the representative particle diameter, and f represents the number of particles having particle diameters in the channel.

Figure 8:
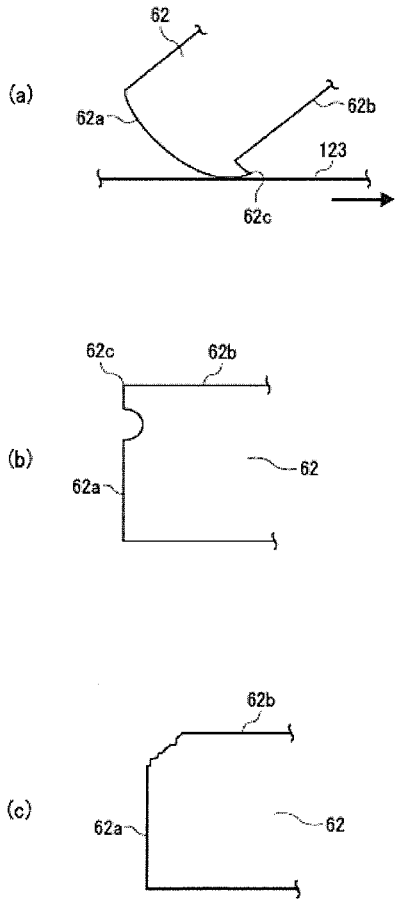
FIG. 8 (Prior Art)
FIGS. 8(*a*) to 8(*c*) are schematic views for explaining how a cleaning blade is damaged.

When such a polymerization toner as mentioned above is used, residual toner remaining on the photoreceptor 3 cannot be satisfactorily removed therefrom using a cleaning blade compared to a case where a conventional pulverization toner is used, thereby easily forming an abnormal image in which background thereof is soiled with residual toner. In attempting to improve the cleanability (i.e., to prevent formation of such an abnormal image) by increasing the contact pressure of the cleaning blade 62 to the photoreceptor 3, another problem in that the cleaning blade is rapidly abraded is caused. In this case, friction between the cleaning blade 62 and the photoreceptor 3 is increased, and thereby the tip of the cleaning blade is pulled by the photoreceptor 3 in the moving direction of the photoreceptor as mentioned above by reference to FIG. 8(*a*). In this regard, the thus everted tip has a restoring force, and the tip tends to vibrate, resulting in generation of fluttering sounds. In addition, when the cleaning blade 62 in such a state is continuously used, the cleaning blade may lack the edge line thereof as illustrated in FIG. 8(*c*).

Figure 1A:
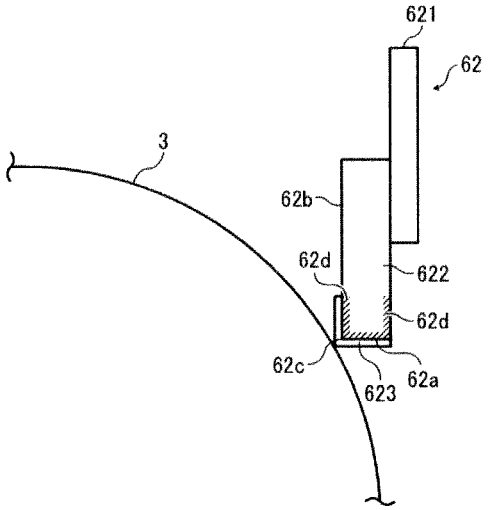
FIGS. 1A and 1B are schematic cross-sectional views illustrating an example of the cleaning blade of this disclosure.
Figure 1B:
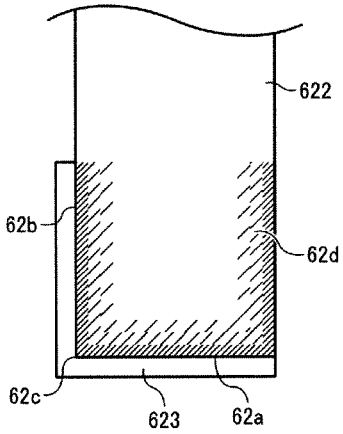
Figure 5:
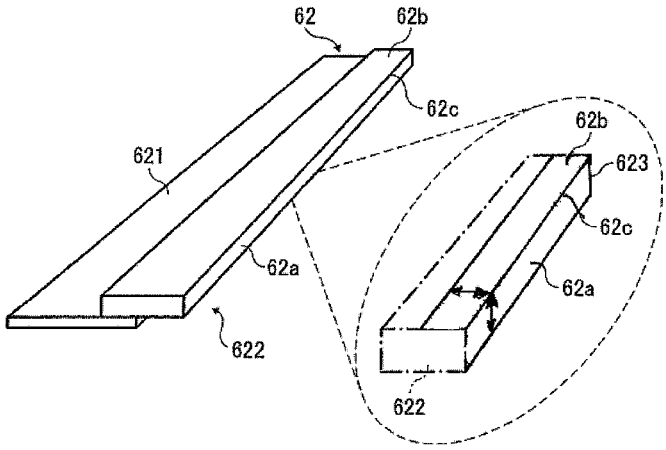
FIG. 5 is a schematic perspective view illustrating an example of the cleaning blade of this disclosure.

FIG. 5 is a perspective view illustrating an example of the cleaning blade of this application, and FIGS. 1A and 1B are enlarged cross-sectional views illustrating the cleaning blade. FIG. 1A illustrates the cleaning blade 62 contacted with a surface of the photoreceptor 3, and FIG. 1B is an enlarged cross-sectional view illustrating the tip of the cleaning blade 62. Referring to FIGS. 5, 1A and 1B, the cleaning blade 62 includes a strip-shaped holder 621 which is made of a rigid material such as metals and hard plastics, and a strip-shaped elastic blade 622. The elastic blade 622 has an edge line 62*c*, which is subjected to an impregnation treatment as mentioned below in detail. In addition, a surface layer 623 is formed on each of surfaces of an apical surface 62*a* and an upper portion of a lower surface 62*b* of the blade 62. As illustrated in FIG. 5, the surface layer 623 extends in the longitudinal direction of the blade 62.

The elastic blade 622 is fixed to an upper end portion of the holder 621, for example, by an adhesive. The other end portion (i.e., the lower end portion) of the holder 621 is supported (cantilevered) by a case of the cleaner 6.

In order that the elastic blade 622 can be satisfactorily contacted with the surface of the photoreceptor 3 even if the photoreceptor 3 is eccentric or the surface thereof is waved, the elastic blade 622 preferably has a high resilience coefficient. Rubbers having a urethane group such as urethane rubbers are preferably used therefor.

The urethane rubber for the elastic blade is typically prepared by a centrifugal molding method. The urethane rubber is preferably made from polyol having an OH value of from 28 to 168 and 2 or 3 hydroxyl groups; diisocyanate such as TDI, MDI, IPDI, HDI, NDI and TOM; and short-chain polyol having an OH value of from 950 to 1,830 such as ethylene glycol, propane diol, butane diol, pentane diol, hexane diol, glycerin, trimethylol ethane and trimethylol propane. These are mixed and placed in a centrifugal mold heated to have a temperature of from 100 to 200° C., released after a predetermined time passes, left in a high temperature and high humidity environment of 30° C. and 85% Rh for 1 week to stabilize properties of the resultant rubber, and cut to have a predetermined form to prepare a strip for elastic blade.

The urethane rubber for the elastic blade has a hardness of from 68 to 80° (JIS A) at 25° C. When greater than 80°, the rubber lacks in flexibility. For example, when the holder 621 is installed at a slight angle, the cleaning blade 62 is difficult to have uniform contact pressure in an axial direction, resulting in deterioration of cleanability. When less than 68°, the cleaning blade 62 warps when the contact pressure is increased to clean even a polymerization toner. Therefore, the edge line 62*c* of the cleaning blade 62 floats above, an under surface 62*b* of the cleaning blade 62 contacts the photoreceptor 3. Then, the cleaning blade 62 and the surface of the photoreceptor rapidly increase in contact area, and a contact pressure is small even when the cleaning blade 62 is pressed with a large pressing force, resulting in deterioration of cleanability. Particularly, the elastic blade having a surface layer at an apical surface of the present invention needs to have this range because of these reasons.

The elastic blade may be a double-layered blade, in which two different materials are layered. Even in this case, the urethane rubber preferably has the above hardness, but the contact side and the non-contact side can have select suitable materials, respectively. When layered urethane having two ore more layers is prepared, materials having different mixing ratios are continuously placed in a centrifugal mold to form an integrated blade without delamination.

At the edge line of the elastic blade 622, an impregnated part 62*d* impregnated with an ultraviolet curable resin including a fluorinated acrylic monomer is formed. The edge line of the elastic blade 622 can be impregnated with an ultraviolet curable resin including a fluorinated acrylic monomer by a spray coating method or a dip coating method. This prevents the edge line 62*c* from being deformed in a travel direction of the photoreceptor 3. Further, even when an inside of the edge line is exposed due to surface abrasion as time passes, the internal impregnation prevents the deformation.

The surface layer 623 is formed by coating the edge line 62*c* of the cleaning blade 622 by a spray coating method or a dip coating method after the elastic blade 622 is impregnated with an ultraviolet curable resin including a fluorinated acrylic monomer and dried by air for a predetermined time. After the elastic blade 622 is impregnated with an ultraviolet curable resin monomer or covered by the surface layer 623, a UV ray is irradiated thereto to form an impregnated part 62*d* in FIG. 1 to increase hardness of the edge line 62*c*. The elastic blade 622 impregnated with a fluorinated acrylic monomer decreases in abrasion near the edge line 62*c*. When the surface layer 623 is abraded as time passes, the edge line of the elastic blade 622 is exposed and contacts the surface of the photoreceptor, but a friction therebetween can be weakened. Further, deformation of the exposed part of the elastic blade 622 in a travel direction of the photoreceptor can be prevented. Consequently, generation of fluttering noises can be prevented. In addition, eversion of the exposed part and missing of the everted part can be prevented. Further, since the edge line of the elastic blade 622 impregnated with a fluorinated acrylic monomer has low friction, the exposed part is difficult to scrape by the photoreceptor 3 to improve abrasion resistance of the cleaning blade 62.

The fluorinated acrylic monomer is preferably an acrylate having a perfluoropolyether skeleton and two or more functional groups. Specific examples of the acrylate having a perfluoropolyether skeleton and two or more functional groups include OPTOOL DAC-HP from Daikin Industries, Ltd. and RS-75 from DEC Corp.

In the present invention, the ultraviolet curable resin is irradiated with a UV ray to improve durability.

This is because the rubber possibly improves in abrasion resistance since a network chain of the ultraviolet curable resin is formed therein to apparently increase crosslink density thereof. It is essential there is almost no chance that the ultraviolet curable resin and the urethane rubber are chemically bonded with each other. When the ultraviolet curable resin and the urethane rubber are chemically bonded with each other, the crosslink density is so high that the rubber becomes close to glass. Therefore, movement of the edge line 62*c* is not restricted and abrasion resistance is thought to improve.

The surface layer 623 is formed on the edge line 62*c* of the cleaning blade 62 by a spray coating method or a dip coating method. The surface layer 623 is preferably formed of a material harder than the elastic blade 622. Being harder than the elastic blade 622, the surface layer 623 is more difficult to scrape by the photoreceptor 3 than the elastic blade 622 to improve abrasion resistance of the cleaning blade 62. In addition, being hard and inflexible, the surface layer 623 is difficult to deform to prevent eversion of the edge line 62*c* of the cleaning blade 62.

The surface layer 623 is preferably formed of a resin, and more preferably formed of an ultraviolet curing resin. An ultraviolet curing resin adhering to the edge line 62*c* of the cleaning blade 62 is just irradiated with a UV ray to form a surface layer 623 having a desired hardness thereon, and the cleaning blade 62 can be prepared at low cost.

The ultraviolet curing resin is preferably formed of a monomer, the main skeleton of which is pentaerythritoltriacrylate having a functional group equivalent molecular weight not greater than 350 and 3 to 6 functional groups. When greater than 350 or a material besides the pentaerythritoltriacrylate skeleton, the surface layer 623 is possibly too fragile. When the surface layer 623 is too fragile, the edge line 62*c* of the cleaning blade 62 is everted and the apical surface is abraded as FIG. 8(*b*) shows, resulting in inability to maintain cleanability for long periods. As a material for the surface layer 623, besides the pentaerythritoltriacrylate skeleton, an acrylate material having a functional group equivalent molecular weight of from 100 to 1,000 and 1 or 2 functional groups is preferably mixed. This can impart flexibility to the surface layer 623 and customize properties thereof in accordance with a machine using the cleaning blade 62. Therefore, the environment properties can be improved, e.g., the blade behavior is finely tuned when making abnormal noises in a specific environment.

The surface layer 623 is preferably formed of the ultraviolet curing resin including a fluorinated acrylic monomer which is the same as the impregnating material. Adhesiveness between the same materials can be expected to improve, which prevents the surface layer 623 from peeling.

The surface layer 623 preferably has a thickness of from 0.2 to 1 μm. When less than 0.2 μm, the surface layer 623 deteriorates in stiffness and the edge line 62*c* of the cleaning blade 62 is likely to be everted. When greater than 1 μm, toners scraping through the blade increase, resulting in poor cleanability. The surface layer 623 is formed by transferring a liquid material such as spray coating and clip coating, and the edge line 62*c* is difficult to coat due to surface tension. Therefore, the surface layer 623 increases in thickness with distance from the edge line 62*c*. When the thickness is larger than 1 μm, a difference between the thickness at the edge line 62*c* and that at a position distant therefrom is large, the edge line 62*c* of the cleaning blade 62 has a blunt angle. When the edge line 62*c* has a blunt angle, an airspace at an upstream side of a contact point between the apical surface 62*a* and the photoreceptor 3 is smaller than when the edge line 62*c* has a right angle. When a toner accumulates in the airspace after prolonged cleaning operation, the toner therein has no place to escape and is gradually pushed out to downstream side of the photoreceptor 3, resulting in poor cleanability.

When the surface layer 623 is formed with an ultraviolet curable resin, the elastic blade 622 formed of urethane rubber is impregnated with the ultraviolet curable resin by a dip coating method. Further, after an ultraviolet curable resin liquid is sprayed on the impregnated blade to form the surface layer 623, the resin is cured by UV irradiation. Before the surface layer 623 is formed, the ultraviolet curable resin impregnated into the elastic blade 622 may be irradiated with UV. This fixes impregnation of the ultraviolet curable resin in the urethane rubber, and even when the ultraviolet curable resin liquid is coated on the impregnated part to form the surface layer 623, the impregnation does not change. Therefore, the elastic blade 622 impregnated as desired can be prepared.

The cleaning blade 62 of the present invention is a layered blade including a surface layer 623 formed of an ultraviolet curable resin including a fluorinated acrylic monomer; a mixed layer including an elastic blade substrate and an ultraviolet curable resin (impregnation material); and an elastic layer formed of only the elastic blade substrate. The impregnation material and the surface layer material are detected near the edge line of the elastic blade 622 of the cleaning blade 62. Detected intensity decreases from the surface impregnated with concentration gradient. Namely, in the cleaning blade of the present invention, there is no definite interface between the inner mixed layer and the elastic layer formed of only the elastic blade substrate. Further, in the cleaning blade 62 of the present invention, since the impregnation material and the surface layer material are the same, an interface between the surface layer and the mixed layer is occasionally indefinite partly because the elastic blade substrate swells when formed. Thus, the cleaning blade 62 of the present invention has a layered structure having indefinite interfaces among the surface layer 623, the mixed layer and the elastic layer.

The impregnation as well as the surface layer 623 change the original elasticity of the urethane rubber substrate. When the impregnation and the surface layer 623 largely change the elasticity of the urethane rubber, the cleaning blade 62 deteriorates in adhesion to the surface of the photoreceptor. When the cleaning blade 62 deteriorates in adhesion to the surface of the photoreceptor, the cleanability thereof occasionally deteriorates in cleaning when producing solid images consuming very much powder on the photoreceptor. Namely, when the surface layer 623 and the impregnated part 62*d* largely change the elasticity of the elastic blade 622 and deteriorate adhesion thereof to the photoreceptor 3, the cleaning blade 62 varies in contact pressure to the surface of the photoreceptor 3 in a longitudinal direction when having eccentricity or a microscopic wave. Consequently, the edge line 62*c* of the cleaning blade 62 deteriorates in followability to the surface of the photoreceptor. When solid images are continuously produced, a large amount of toner are dammed and increase in pressure strength to the cleaning blade 62. Therefore, at a part of the cleaning blade 62 contacting the photoreceptor 3 at lower pressure, when the pressure strength of the toner on the photoreceptor to the cleaning blade 62 is larger than the contact pressure of the cleaning blade 62, the part cannot maintain contacting the photoreceptor. Therefore, a toner scrapes through the cleaning blade 62. Consequently, the cleanability thereof occasionally deteriorates in cleaning when producing solid images consuming very much powder on the photoreceptor 3. Particularly, in an image forming apparatus having a lubricant applicator, a lubricant applied on a photoreceptor is electrified to deteriorate by a charger such as a charging roller, resulting in generation of viscosity. Therefore, as an adverse effect, the edge line of the cleaning blade deteriorates in followability to the surface of the photoreceptor, resulting in occasional deterioration in cleaning.

The reason is not clarified, but when the impregnation and the surface layer 623 changes the original elasticity of the urethane rubber substrate, the blade abrasion occasionally increases. In order to avoid the poor cleaning due to deterioration of adhesion to the surface of a photoreceptor and increase of blade abrasion, the impregnation and the surface layer 623 need optimizing. The present inventors conducted verification experiments from various points of view, changing the material of the elastic blade 622, the material of the surface layer 623, the impregnation method and formation of the surface layer an 623 on the under surface of the blade to find optimum specifications of the impregnation and the surface layer 623.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Verification Experiment 1

Durability tests were conducted, changing the material of the elastic blade 622, the material of the surface layer 623, the impregnation method and formation of the surface layer 623 on the under surface of the blade to find optimum specifications of the impregnation and the surface layer 623.

[Elastic Blade]

The following materials were used for the elastic blade 622.

| Material | Hardness (°) at 25° C. | Resilience coefficient (%) at 25° C. | Manufacturer |
|---|---|---|---|
| Urethane rubber 1 | 72 | 31 | Toyo Tire & Rubber Co., Ltd. |
| Urethane rubber 2 | 69 | 50 | Toyo Tire & Rubber Co., Ltd. |
| Urethane rubber 3 | 68 | 30 | Toyo Tire & Rubber Co., Ltd. |
| Urethane rubber 4 | 75 | 45 | Toyo Tire & Rubber Co., Ltd. |
| Urethane rubber 5 (double layered) | Under surface hardness 80 Opposite side hardness 75 | 25 | Toyo Tire & Rubber Co., Ltd. |
| Urethane rubber 6 (double layered) | Under surface hardness 80 Opposite side hardness 75 | 30 | Bando Chemical Industries, Ltd. |

The hardness of the urethane rubbers 1 to 6 was measured by a method defined in JIS K6253 using a durometer MD-1 from KOBUNSHI KEIKI CO., LTD. Both side of the hardness of the double-layered blade were measured.

The resilience coefficient of the urethane rubbers 1-5 was measured by a method defined in JIS K6255 using a resilience tester No. 221 manufactured by Toyo Seiki Seisaku-Sho Ltd. When measuring the resilience coefficient, sheets (with a thickness of about 2 mm) of each of the urethane rubbers were overlaid so that the rubber has a thickness of not less than 4 mm.

[Impregnation and Surface Layer Material]

The following curing materials 1 to 8 were used to impregnate and to form a surface lay 623.

| <Curing Material 1> | |
|---|---|
| Resin 1: PETIA (from DAICEL-CYTEC Co., Ltd.) | 8 |
| Resin 2: ODA-N (from DAICEL-CYTEC Co., Ltd.) | 2 |
| Resin 3: OPTOOL DAC-HP (from Daikin Industries, Ltd.) | 0.1 |
| Polymerization initiator: IRGACURE 184 (from Ciba Specialty Chemicals) | 0.5 |
| Solvent: Cyclohexanone | 89.4 |
| <Curing Material 2> | |
| Resin 1: PETIA (from DAICEL-CYTEC Co., Ltd.) | 7 |
| Resin 2: HDDA (from DAICEL-CYTEC Co., Ltd.) | 3 |
| Polymerization initiator: IRGACURE 184 (from Ciba Specialty Chemicals) | 0.5 |
| Solvent: Cyclohexanone | 89.5 |
| <Curing Material 3> | |
| Resin 1: PETIA (from DAICEL-CYTEC Co., Ltd.) | 10 |
| Resin 2: OPTOOL DAC-HP (from Daikin Industries, Ltd.) | 0.1 |
| Polymerization initiator: IRGACURE 184 (from Ciba Specialty Chemicals) | 0.5 |
| Solvent: Cyclohexanone | 89.4 |
| <Curing Material 4> | |
| Resin 1: PETIA (from DAICEL-CYTEC Co., Ltd.) | 8 |
| Resin 2: IBOA (from DAICEL-CYTEC Co., Ltd.) | 2 |
| Resin 3: OPTOOL DAC-HP (from Daikin Industries, Ltd.) | 0.1 |
| Polymerization initiator: IRGACURE 184 (from Ciba Specialty Chemicals) | 0.5 |
| Solvent: Cyclohexanone | 89.4 |
| <Curing Material 5> | |
| Resin 1: PETIA (from DAICEL-CYTEC Co., Ltd.) | 7 |
| Resin 2: EBECRYL 11 (from DAICEL-CYTEC Co., Ltd.) | 3 |
| Resin 3: OPTOOL DAC-HP (from Daikin Industries, Ltd.) | 0.1 |
| Polymerization initiator: IRGACURE 184 (from Ciba Specialty Chemicals) | 0.5 |
| Solvent: Cyclohexanone | 89.4 |
| <Curing Material 6> | |
| Resin 1: DPHA (from DAICEL-CYTEC Co., Ltd.) | 10 |
| Polymerization initiator: IRGACURE 184 (from Ciba Specialty Chemicals) | 1 |
| Solvent: Cyclohexanone | 89 |
| <Curing Material 7> | |
| Resin 1: DPCA-120 (from Nippon Kayaku Co., Ltd.) | 8 |
| Resin 2: IBOA (from DAICEL-CYTEC Co., Ltd.) | 2 |
| Resin 3: RS-75 (from DIC Corp.) | 0.1 |
| Polymerization initiator: IRGACURE 184 (from Ciba Specialty Chemicals) | 0.5 |
| Solvent: Cyclohexanone | 89.4 |
| <Curing Material 8> | |
| Resin 1: PETIA (from DAICEL-CYTEC Co., Ltd.) | 5 |
| Resin 2: UN2700 (from Negami Chemical Industrial Co., Ltd.) | 5 |
| Resin 3: RS-75 (from DIC Corp.) | 0.1 |
| Polymerization initiator: IRGACURE 184 (from Ciba Specialty Chemicals) | 0.5 |
| Solvent: Cyclohexanone | 89.4 |

OPTOOL DAC-HP from Daikin Industries, Ltd. and RS-75 from DIC Corp. are fluorinated acrylic monomers having a perfluoropolyether skeleton and acrylates having tow or more functional groups. Namely, the curing materials 1, 3, 4, 5, 7 and 8 are ultraviolet curing resins including a fluorinated acrylic monomer.

Acrylic materials, main skeletons, functional group numbers and functional group equivalents of the ultraviolet curing resins used in the curing materials are shown in Table I.

TABLE 1

| Acrylic monomer | Main skeleton | Functional group number | Functional group equivalent |
|---|---|---|---|
| PETIA<br>Pentaerythritol triacrylate | Pentaerythritol triacrylate | 3 | 99 |
| DPHA<br>Dipentaerythritol triacrylate | Pentaerythritol triacrylate | 6 | 96 |
| DPCA-120<br>ϵ-caprolactone modified pentaerythritol triacrylate | Pentaerythritol triacrylate | 6 | 325 |
| ODA-N<br>Octyl/decyl acryalte | — | 1 | 226 |
| IBOA<br>Isobornyl acrylate | — | 1 | 198 |
| EBECRYL11<br>EO-modified diacrylate | — | 2 | 263 |
| HDDA<br>Hexanediol diacrylate | — | 2 | 113 |
| UN-2700<br>Urethane acrylate | — | 2 | 1,000 |

As Table 1 shows, PETIA and DPHA from DAICEL-CYTEC Co., Ltd., and DPCA-120 from Nippon Kayaku Co., Ltd. are acrylate materials having pentaerythritol triacrylate having a functional group equivalent molecular weight not greater than 350 and 3 to 6 functional groups as a main skeleton, ODA-N, HDDA, IBOA, EBCRYL11 and UN2700 from DAICEL-CYTEC Co., Ltd. are acrylate materials having a functional group equivalent molecular weight of from 100 to 1,000 and 1 or 2 functional groups. The curing materials 1, 2, 4, 5, 7 and 8 are mixtures of the acrylate material having pentaerythritol triacrylate having a functional group equivalent molecular weight not greater than 350 and 3 to 6 functional groups as a main skeleton and the acrylate material having a functional group equivalent molecular weight of from 100 to 1,000 and 1 or 2 functional groups.

Next, the configuration of an image forming apparatus used for the verification experiment is explained.

A strip-shaped elastic blade having a thickness of 1.8 mm was made from one of the urethane rubbers 1 to 6. The edge of the blade was dipped in each of the curing materials at a depth of 1.8 mm which is almost equal to the thickness thereof for a predetermined time to be impregnated, and dried for 3 min. Then, a surface layer was formed by a spray coating method with each of the curing materials. Specifically, the edge of the blade was sprayed by a spray gun at 10 mm/s such that a surface layer had a predetermined thickness, naturally dried for 3 min, and the under surface of the blade was similarly coated to form a surface layer thereon. Then, the surface layer naturally dried further for 3 min and irradiated with a UV ray (140 W/cm×5 m/min×5 passes). The surface layer forming area was limited with a masking tape.

The thickness of the surface layer was measured by a microscope VHX-100 from Keyence Corporation using a cross-section of another elastic blade similarly coated. The surface layer was cut to show a cross-section by a trimming razor for preparing a sample for SEM from Nisshin EM Corp.

Figure 6:
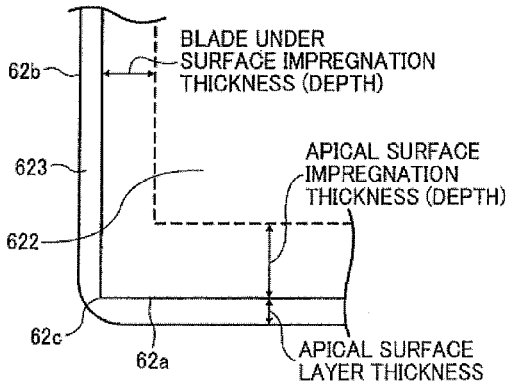
FIG. 6 is a schematic view illustrating an impregnation depth of the elastic blade and a point measured as the thickness of the surface layer.

As mentioned above, the impregnation material and the surface layer material are detected near the edge line of the elastic blade, and the detected intensity decreases from the surface impregnated with concentration gradient. The impregnation depth was a distance from the surface to a point where the impregnation material and the surface layer material were almost undetected. Specifically, the impregnation depth (area) was measured as follows. A cross-sectional thin slice of the edge was prepared by a cryomicrotome EM FCS from Leica Microsystems, and was measured by a transmission microscope FT-IR (IR microscope Continupm from Thermo Electron Corp. As FIG. 6 shows, the variance in the cross-section was measured with reference to the apical surface 62*a* and the under surface 62*b*. The impregnation depth of the acrylic compound was measured by dividing a peak area around 1710 $cm^{-1}$ with a peak area at 1415 $cm^{-1}$ to determine a value and standardizing the value with a value of the non-impregnation part as an index.

The elastic blade a surface layer is formed on was fixed with an adhesive on a metallic plate holder installable in color complex machine imagio MP C4500 from Ricoh Company, Ltd. as a trial cleaning blade. The cleaning blade was installed in color complex machine imagio MP 04500 from Ricoh Company, Ltd. having the same configuration in FIG. 1 to prepare image forming apparatuses in Examples 1-1 to 1-5 and Comparative Examples 1-1 to 1-3. A linear pressure and a cleaning angle of the cleaning blade were determined from a predetermined edge burial amount and a mounting angle.

A toner prepared by a polymerization method was used in the verification experiment. The toner had the following properties.

A mother toner had a circularity of 0.98 and an average particle diameter of 4.9 μm. As external additives, 1.5 parts of silica having a small particle diameter (H2000 from Clariant), 0.5 parts of titanium oxide having a small particle diameter (MT-150AI from Tayca Corp.) and 1.0 part of silica having a large particle diameter (UFP-30H from DENKA DENKI KAGAKU KOGYO KABUSHIKI KAISHA) were used.

The verification experiment was conducted by producing 100,000 images (A4 in a longitudinal direction) having an image area ratio of 5% at 3 prints/job in an environment of 21° C. and 65% RH.

[Evaluated Matters]

Poor cleaning: Visual observation

Image quality: Twenty (20) three-stripe patterns (relative to paper traveling direction) having a width of 43 mm were produced (A4 in a longitudinal direction)

Figure 7:
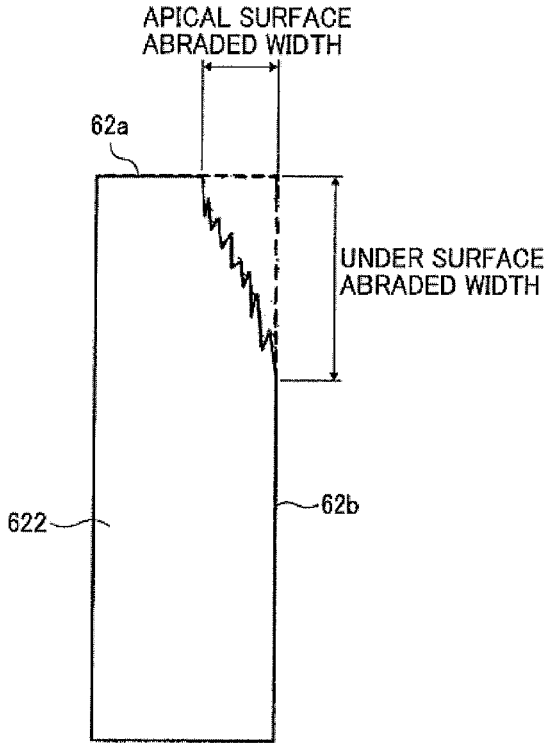
FIG. 7 is a schematic view for explaining the way to determine width of an abraded portion of an elastic blade.

Blade edge apical surface abraded width: Abraded width seen from the apical surface of the blade in FIG. 7

Blade edge under surface abraded width: Abraded width seen from the under surface of the blade in FIG. 7

Blade edge surface crack and peeling: The surface crack and peeling of the apical surface and the under surface of the blade were observed with a microscope The results of the verification experiment of Examples 1-1 to 1-5 and Comparative Examples 1-1 to 1-3.

Example 1-1

Base Urethane Rubber (A): Urethane Rubber 2

Impregnation and Surface Layer Material (B): Curing Material 1

Impregnation Time: 60 sec

Apical Surface Impregnation Depth (C): 80 μm

Under Surface Impregnation Depth (D): 70 μm

Surface Layer Thickness on Apical and Under Surfaces (E): 1.0 μm

Blade Edge Abraded Cross-sectional Area (F): 60 $\mu m^2$

Apical Surface Abraded Width/Under Surface Abraded Width (G): 0.30

Poor Cleaning (H): None

Abnormal Noise (I): None

Blade Surface Crack and Peeling (J): None

Example 1-2

Base Urethane Rubber: Urethane Rubber 1

Impregnation and Surface Layer Material: Curing Material 4

Impregnation Time: 120 sec

Apical Surface Impregnation Depth: 150 μm

Under Surface impregnation Depth: 100 μm

Surface Layer Thickness on Apical and Under Surfaces: 0.6 μm

Blade Edge Abraded Cross-sectional Area: 90 $\mu m^2$

Apical Surface Abraded Width/Under Surface Abraded Width: 0.65

Poor Cleaning: None

Abnormal Noise: None

Blade Surface Crack and Peeling: None

Example 1-3

Base Urethane Rubber: Urethane Rubber 5

Impregnation and Surface Layer Material: Curing Material 7

Impregnation Time: 30 sec

Apical Surface Impregnation Depth: 60 μm

Under Surface Impregnation Depth: 40 μm

Surface Layer Thickness on Apical and Under Surfaces: 0.8 μm

Blade Edge Abraded Cross-sectional Area: 20 $\mu m^2$

Apical Surface Abraded Width/Under Surface Abraded Width: 0.25

Poor Cleaning: None

Abnormal Noise: None

Blade Surface Crack and Peeling: None

Example 1-4

Base Urethane Rubber: Urethane Rubber 3

Impregnation and Surface Layer Material: Curing Material 9

Impregnation Time: 90 sec

Apical Surface Impregnation Depth: 100 μm

Under Surface Impregnation Depth: 80 μm

Surface Layer Thickness on Apical and Under Surfaces: 0.5 μm

Blade Edge Abraded Cross-sectional Area: 50 $\mu m^2$

Apical Surface Abraded Width/Under Surface Abraded Width: 0.35

Poor Cleaning: None

Abnormal Noise: None

Blade Surface Crack and Peeling: None

Example 1-5

Base Urethane Rubber: Urethane Rubber 6

Impregnation and Surface Layer Material: Curing Material 5

Impregnation Time: 30 sec

Apical Surface Impregnation Depth: 50 μm

Under Surface Impregnation Depth: 20 μm

Surface Layer Thickness on Apical and Under Surfaces: 0.8 μm

Blade Edge Abraded Cross-sectional Area: 40 $\mu m^2$

Apical Surface Abraded Width/Under Surface Abraded Width: 0.50

Poor Cleaning: None
Abnormal Noise: None
Blade Surface Crack and Peeling: None

Comparative Example 1-1

Base Urethane Rubber: Urethane Rubber 4
Impregnation Material: Curing Material 3 (No Surface Layer)
Impregnation Time: 30 sec
Apical Surface Impregnation Depth: 50 μm
Under Surface Impregnation Depth: 30 μm
Surface Layer Thickness on Apical and Under Surfaces: 0 μm
Blade Edge Abraded Cross-sectional Area: 150 $\mu m^2$
Apical Surface Abraded Width/Under Surface Abraded Width: 0.75
Poor Cleaning: 2 stripe poor cleaning
Abnormal Noise: None
Apical surface was scooped and abraded Comparative Example 1-2

Base Urethane Rubber: Urethane Rubber 6
Surface Layer Material: Curing Material 6
Impregnation Time: 0 sec
Apical Surface Impregnation Depth: 0 μm
Under Surface Impregnation Depth: 0 μm
Surface Layer Thickness on Apical and Under Surfaces: 3.0 μm
Blade Edge Abraded Cross-sectional Area: 220 $\mu m^2$
Apical Surface Abraded Width/Under Surface Abraded Width: 0.40
Poor Cleaning: 2 stripe poor cleaning
Blade Surface Crack and Peeling: Observed
Abnormal Noise: Oscillation noise Comparative Example 1-3

Base Urethane Rubber: Urethane Rubber 2
Impregnation and Surface Layer Material: Curing Material 2
Impregnation Time: 30 sec
Apical Surface Impregnation Depth: 30 μm
Under Surface Impregnation Depth: 10 μm
Surface Layer Thickness on Apical and Under Surfaces: 0.8 μm
Blade Edge Abraded Cross-sectional Area: 90 $\mu m^2$
Apical Surface Abraded Width/Under Surface Abraded Width: 0.80
Blade Surface Crack and Peeling: None
Poor Cleaning: 2 stripe poor cleaning
Abnormal Noise: None
Apical surface was scooped and abraded

TABLE 2

| | (A) | (B) | (C) | (D) | (E) | (F) | (G) | (H) | (I) | (J) | Others |
|---|---|---|---|---|---|---|---|---|---|---|---|
| Example 1-1 | 2 | 1 | 80 | 70 | 1.0 | 60 | 0.30 | None | None | None | |
| Example 1-2 | 1 | 4 | 150 | 100 | 0.6 | 90 | 0.65 | None | None | None | |
| Example 1-3 | 5 | 7 | 60 | 40 | 0.8 | 20 | 0.25 | None | None | None | |
| Example 1-4 | 3 | 8 | 100 | 80 | 0.5 | 50 | 0.35 | None | None | None | |
| Example 1-5 | 6 | 5 | 50 | 20 | 0.8 | 40 | 0.50 | None | None | None | |
| Comparative Example 1-1 | 4 | 3 | 50 | 30 | — | 150 | 0.75 | 2 stripe | None | — | Apical Surface Scooped Abraded |
| Comparative Example 1-2 | 6 | 6 | — | — | 3.0 | 220 | 0.40 | 2 stripe | Oscil-lation | Observed | |
| Comparative Example 1-3 | 2 | 2 | 30 | 10 | 0.8 | 90 | 0.80 | 2 stripe | None | None | Apical Surface Scooped Abraded |

Table 2 is a summary of the verification experiment results of Examples 1-1 to 1-5 and Comparative Examples 1-1 to 1-3.

As Table 2 shows, Comparative Example 1-1 having no surface layer 623 did not have enough stiffness around the edge line 62*c*, resulting in scooped and abraded apical surface. Comparative Example 1-2 generated oscillation noise, and stripe poor cleaning was observed. This is thought to be because the elastic blade 622 was not impregnated and an exposed part thereof due to abrasion as time passes is deformed in a surface travel direction of a photoreceptor. Not impregnated, the elastic blade 622 did not have enough abrasion resistance and an edge abrasion cross-sectional area of 220 μm. In Comparative Example 1-3, stripe poor cleaning was observed and the apical surface was scooped and abraded. This is thought to be because the impregnation depth was not enough, i.e., the apical surface impregnation depth was 30 μm and the under surface impregnation depth was 10 μm, resulting in insufficient stiffness of the edge line. Further, the elastic blade was thought not to have tow friction enough because the curing material 2 not including a fluorinated acrylic monomer was used. This is why the apical surface was scooped and abraded.

In Comparative Example 1-2 which was not impregnated, crack and peeling of the surface layer were observed. The elastic layer of the elastic blade and the surface layer are largely different from each other in hardness, and when the cleaning blade contacts the surface of a photoreceptor, the elastic layer is elastically deformed by contact pressure, but the hard surface layer is hardly deformed. As a result, it is thought a large stress was applied to the surface layer and the surface layer had crack. In addition, since the surface layer and the elastic blade are formed of different materials, the surface layer is thought to have peeled from the elastic blade due to insufficient adhesiveness.

Next, verification experiment 2 is explained.

Verification Experiment 2

Verification experiment 2 was conducted to see relations among hardness of the apical surface 62*a* and the under surface 62*b* of the cleaning blade 62, cleanability, abrasion resistance, and abnormal noise.

The hardness of the apical surface and the under surface were measured by a micro hardness tester FISCHER SCOPE HM2000 from FISCHER as Martens hardness at a position 100 μm distant from the edge line at a push in depth of 20 μm from the surface of the apical surface and the under surface.

A urethane rubber 7 having a hardness of 76° and a resilience coefficient of 32% at 25° C. (from SYNZTEC CO., LTD.) was used as well in addition to the urethane rubbers 1 to 6.

The other conditions are the same as those in verification experiment 1,

Example 2-1

Base Urethane Rubber (A): Urethane Rubber 1
Impregnation and Surface Layer Material (B): Curing Material 4
Impregnation Time: 90 sec
Apical Surface Impregnation Depth (C): 100 μm
Under Surface Impregnation Depth (D): 80 μm
Surface Layer Thickness on Apical and Under Surfaces (E): 0.5 μm
Apical Surface Hardness (K): 1.3 N/mm$^2$
Under Surface Hardness (L): 1.0 N/mm$^2$
Blade Edge Abraded Cross-sectional Area (F): 30 μm$^2$
Poor Cleaning (H): None
Abnormal Noise (I): None
Blade Surface Crack and Peeling (J): None Example 2-2

Base Urethane Rubber: Urethane Rubber 3
Impregnation and Surface Layer Material: Curing Material 1
Impregnation Time: 60 sec
Apical Surface Impregnation Depth: 60 μm
Under Surface Impregnation Depth: 50 μm
Surface Layer Thickness on Apical and Under Surfaces (E): 0.5 μm
Apical Surface Hardness: 1.3 N/min$^2$
Under Surface Hardness: 0.9 N/mm$^2$
Blade Edge Abraded Cross-sectional Area: 20 μm$^2$
Poor Cleaning: None
Abnormal Noise: None
Blade Surface Crack and Peeling: None Example 2-3

Base Urethane Rubber: Urethane Rubber 1
Impregnation and Surface Layer Material: Curing Material 5
Impregnation Time: 90 sec
Apical Surface Impregnation Depth: 80 μm
Under Surface Impregnation Depth: 70 μm
Surface Layer Thickness on Apical and Under Surfaces: 0.8 μm
Apical Surface Hardness: 1.2 N/mm$^2$
Under Surface Hardness: 1.0 N/mm$^2$
Blade Edge Abraded Cross-sectional Area: 50 μm$^2$
Poor Cleaning: None
Abnormal Noise: None
Blade Surface Crack and Peeling: None Example 2-4

Base Urethane Rubber: Urethane Rubber 2
Impregnation and Surface Layer Material: Curing Material 1
Impregnation Time: 120 sec
Apical Surface Impregnation Depth: 100 μm
Under Surface Impregnation Depth: 80 μm
Surface Layer Thickness on Apical and Under Surfaces: 0.8 μm
Apical Surface Hardness: 1.3 N/mm$^2$
Under Surface Hardness: 1.1 N/mm$^2$
Blade Edge Abraded Cross-sectional Area: 50 μm$^2$
Poor Cleaning: None
Abnormal Noise: None
Blade Surface Crack and Peeling: None Example 2-5

Base Urethane Rubber: Urethane Rubber 7
Impregnation and Surface Layer Material: Curing Material 3
Impregnation Time: 90 sec
Apical Surface Impregnation Depth: 80 μm
Under Surface Impregnation Depth: 60 μm
Surface Layer Thickness on Apical and Under Surfaces: 0.6 μm
Apical Surface Hardness: 1.2 N/mm$^2$
Under Surface Hardness: 0.9 N/mm$^2$
Blade Edge Abraded Cross-sectional Area: 60 μm$^2$
Poor Cleaning: None
Abnormal Noise: None
Blade Surface Crack and Peeling: None Example 2-6

Base Urethane Rubber: Urethane Rubber 4
Impregnation and Surface Layer Material: Curing Material 5
Impregnation Time: 60 sec
Apical Surface Impregnation Depth: 60 μm
Under Surface Impregnation Depth: 40 μm
Surface Layer Thickness on Apical and Under Surfaces: 0.8 μm
Apical Surface Hardness: 1.2 N/mm$^2$
Under Surface Hardness: 1.0 N/mm$^2$
Blade Edge Abraded Cross-sectional Area: 80 μm$^2$
Poor Cleaning: None
Abnormal Noise: None
Blade Surface Crack and Peeling: None Example 2-7

Base Urethane Rubber: Urethane Rubber 1
Impregnation and Surface Layer Material: Curing Material 7
Impregnation Time: 60 sec
Apical Surface Impregnation Depth: 60 μm
Under Surface Impregnation Depth: 30 μm
Surface Layer Thickness on Apical and Under Surfaces: 1.0 μm
Apical Surface Hardness: 1.3 N/mm$^2$
Under Surface Hardness: 1.0 N/mm$^2$
Blade Edge Abraded Cross-sectional Area: 90 μm$^2$
Poor Cleaning: None
Abnormal Noise: None
Blade Surface Crack and Peeling: None Comparative Example 2-1

Base Urethane Rubber: Urethane Rubber 2
Impregnation and Surface Layer Material: Curing Material 6
Impregnation Time: 30 sec
Apical Surface Impregnation Depth: 10 μm
Under Surface Impregnation Depth: 10 μm
Surface Layer Thickness on Apical and Under Surfaces: 0.5 μm
Apical Surface Hardness: 1.0 N/mm$^2$
Under Surface Hardness: 1.0 N/mm$^2$
Blade Edge Abraded Cross-sectional Area: 120
Poor Cleaning: 3 stripe poor cleaning
Abnormal Noise: None
Blade Surface Crack and Peeling: None
Apical surface was scooped and abraded Comparative Example 2-2

Base Urethane Rubber: Urethane Rubber 1
Impregnation and Surface Layer Material: Curing Material 2
Impregnation Time: 0 sec
Apical Surface Impregnation Depth: 0 μm
Under Surface Impregnation Depth: 0 μm
Surface Layer Thickness on Apical and Under Surfaces: 0.6 μm
Apical Surface Hardness: 0.9 N/mm$^2$
Under Surface Hardness: 1.0 N/mm$^2$
Blade Edge Abraded Cross-sectional Area: 180 μm$^2$
Poor Cleaning: 2 stripe poor cleaning
Abnormal Noise: Oscillation noise Comparative Example 2-3

Base Urethane Rubber: Urethane Rubber 3
Impregnation and Surface Layer Material: Curing Material 2
Impregnation Time: 30 sec
Apical Surface Impregnation Depth: 40 μm
Under Surface Impregnation Depth: 20 μm
Surface Layer Thickness on Apical and Under Surfaces: 0 μm
Apical Surface Hardness: 0.9 N/mm$^2$
Under Surface Hardness: 0.9 N/mm$^2$
Blade Edge Abraded Cross-sectional Area: 200 μm$^2$
Poor Cleaning: 3 stripe poor cleaning
Abnormal Noise: None Comparative Example 2-4

Base Urethane Rubber: Urethane Rubber 4
Impregnation and Surface Layer Material: Curing Material 6
Impregnation Time: 30 sec
Apical Surface Impregnation Depth: 20 μm
Under Surface Impregnation Depth: 10 μm
Surface Layer Thickness on Apical and Under Surfaces: 2.0 μm
Apical Surface Hardness: 1.0 N/mm$^2$
Under Surface Hardness: 1.0 N/mm$^2$
Blade Edge Abraded Cross-sectional Area: 180 μm$^2$
Poor Cleaning: 2 stripe poor cleaning
Abnormal Noise: Oscillation noise Comparative Example 2-5

Base Urethane Rubber: Urethane Rubber 7
Impregnation and Surface Layer: None
Apical Surface Hardness: 0.9 N/mm$^2$
Under Surface Hardness: 0.9 N/mm$^2$
Blade Edge Abraded Cross-sectional Area: 100 μm$^2$
Poor Cleaning: 5 stripe poor cleaning
Abnormal Noise: None
Apical surface was scooped and abraded

TABLE 3

| | (A) | (B) | (C) | (D) | (E) | (K) | (L) | (F) | (H) | (I) | (J) | Others |
|---|---|---|---|---|---|---|---|---|---|---|---|---|
| Example 2-1 | 1 | 4 | 100 | 80 | 0.5 | 1.3 | 1.0 | 30 | None | None | None | |
| Example 2-2 | 3 | 1 | 60 | 50 | 0.5 | 1.3 | 0.9 | 20 | None | None | None | |
| Example 2-3 | 1 | 5 | 80 | 70 | 0.8 | 1.2 | 1.0 | 50 | None | None | None | |
| Example 2-4 | 2 | 1 | 100 | 80 | 0.8 | 1.3 | 1.1 | 60 | None | None | None | |
| Example 2-5 | 7 | 3 | 80 | 60 | 0.6 | 1.2 | 0.9 | 60 | None | None | None | |
| Example 2-6 | 4 | 6 | 60 | 40 | 0.8 | 1.2 | 1.0 | 80 | None | None | None | |
| Example 2-7 | 1 | 7 | 60 | 30 | 1.0 | 1.3 | 1.0 | 80 | None | None | None | |
| Comparative Example 2-1 | 2 | 6 | 10 | 10 | 0.5 | 1.0 | 1.0 | 120 | 3 stripe | None | None | Apical Surface Scooped Abraded |
| Comparative Example 2-2 | 1 | 2 | — | — | 0.6 | 0.9 | 1.0 | 180 | 2 stripe | Oscil-lation | Observed | |
| Comparative Example 2-3 | 3 | 2 | 40 | 20 | — | 0.9 | 0.9 | 200 | 3 stripe | None | — | |
| Comparative Example 2-4 | 4 | 6 | 20 | 10 | 20 | 1.0 | 1.0 | 180 | 2 stripe | Oscil-lation | Observed | |
| Comparative Example 2-5 | 7 | — | — | — | — | 0.9 | 0.9 | 100 | 5 stripe | None | — | Apical Surface Scooped Abraded |

Table 3 is a summary of the verification experiment results of Examples 2-1 to 2-7 and Comparative Examples 2-1 to 2-5.

As FIG. 3 shows, when the Martens hardness of the apical surface 62 a is higher than that of the under surface 62*b*, the abrasion is prevented and good cleanability is maintained for long periods without oscillation noise.

Next, verification experiment 3 is explained.

Relations among a product of the impregnation depth from the apical surface 62*a* and the thickness of the surface layer 623 thereon, cleanability, abrasion resistance and abnormal noise were examined.

Namely, the impregnation depth and the surface layer thickness have a large difference in number from each other. As an index representing a relation therebetween, when a sum thereof is used, the impregnation depth is dominant. Therefore, the sum was not thought to well explain the relation. Then, the product of the impregnation depth from the apical surface 62*a* and the thickness of the surface layer 623 was used.

The following curing materials were used in the verification experiment 3 as well in addition to the curing materials 1 to 8.

| <Curing Material 9> | |
|---|---|
| Resin 1: PETIA (from DAICEL-CYTEC Co., Ltd.) | 7 |
| Resin 2: HDDA (from DAICEL-CYTEC Co., Ltd.) | 3 |
| Resin 3: RS-75 (from DIC Corp.) | 0.1 |
| Polymerization initiator: IRGACURE 184 (from Ciba Specialty Chemicals) | 0.5 |
| Solvent: Cyclohexanone | 89.4 |

| <Curing Material 9> | |
|---|---|
| Resin 1: PETIA (from DAICEL-CYTEC Co., Ltd.) | 7 |
| Resin 2: EBECRYL 11 (from DAICEL-CYTEC Co., Ltd.) | 3 |
| Resin 3: RS-75 (from DIC Corp.) | 0.1 |
| Polymerization initiator: IRGACURE 184 (from Ciba Specialty Chemicals) | 0.5 |
| Solvent: Cyclohexanone | 89.4 |

Example 3-1

Base Urethane Rubber (A): Urethane Rubber 1
Impregnation and Surface Layer Material (B): Curing Material 1
Impregnation Time: 60 sec
Apical Surface Impregnation Depth (C): 60 μm
Surface Layer Thickness on Apical and Under Surfaces (E): 0.5 μm
(C)*(E): 30 $\mu m^2$
Blade Edge Abraded Cross-sectional Area (F): 20 $\mu m^2$
Poor Cleaning (H): None
Abnormal Noise (I): None
Blade Surface Crack and Peeling (J): None Example 3-2

Base Urethane Rubber: Urethane Rubber 4
Impregnation and Surface Layer Material: Curing Material 3
Impregnation Time: 60 sec
Apical Surface Impregnation Depth (C): 40 μm
Surface Layer Thickness on Apical and Under Surfaces (E): 0.3 μm
(C)*(E): 12 $\mu m^2$
Blade Edge Abraded Cross-sectional Area: 30 $\mu m^2$
Poor Cleaning: None
Abnormal Noise: None
Blade Surface Crack and Peeling: None Example 3-3

Base Urethane Rubber: Urethane Rubber 2
Impregnation and Surface Layer Material: Curing Material 4
Impregnation Time: 90 sec
Apical Surface Impregnation Depth (C): 80 μm
Surface Layer Thickness on Apical and Under Surfaces (E): 0.8 μm
(C)*(E): 64 $\mu m^2$
Blade Edge Abraded Cross-sectional Area: 70 $\mu m^2$
Poor Cleaning: None
Abnormal Noise: None
Blade Surface Crack and Peeling: None Example 3-4

Base Urethane Rubber: Urethane Rubber 1
Impregnation and Surface Layer Material: Curing Material 9
Impregnation Time: 90 sec
Apical Surface Impregnation Depth (C): 100 μm
Surface Layer Thickness on Apical and Under Surfaces (E): 1.0 μm
(C)*(E): 100 $\mu m^2$
Blade Edge Abraded Cross-sectional Area: 60 $\mu m^2$
Poor Cleaning: None
Abnormal Noise: None
Blade Surface Crack and Peeling: None Example 3-5

Base Urethane Rubber: Urethane Rubber 3
Impregnation and Surface Layer Material: Curing Material 5
Impregnation Time: 60 sec
Apical Surface Impregnation Depth (C): 60 μm
Surface Layer Thickness on Apical and Under Surfaces (E): 0.6 μm
(C)*(E): 36 $\mu m^2$
Blade Edge Abraded Cross-sectional Area: 90 $\mu m^2$
Poor Cleaning: None
Abnormal Noise: None
Blade Surface Crack and Peeling: None Example 3-6

Base Urethane Rubber: Urethane Rubber 4
Impregnation and Surface Layer Material: Curing Material 1
Impregnation Time: 60 sec
Apical Surface Impregnation Depth (C): 80 μm
Surface Layer Thickness on Apical and Under Surfaces (E): 1.0 μm
(C)*(E): 80 $\mu m^2$
Blade Edge Abraded Cross-sectional Area: 50 $\mu m^2$
Poor Cleaning: None
Abnormal Noise: None
Blade Surface Crack and Peeling: None Example 3-7

Base Urethane Rubber: Urethane Rubber 2
Impregnation and Surface Layer Material: Curing Material 10
Impregnation Time: 60 sec
Apical Surface Impregnation Depth (C): 60 μm
Surface Layer Thickness on Apical and Under Surfaces (E): 0.8 μm
(C)*(E): 48 $\mu m^2$
Blade Edge Abraded Cross-sectional Area: 40 $\mu m^2$
Poor Cleaning: None
Abnormal Noise: None
Blade Surface Crack and Peeling: None Comparative Example 3-1

Base Urethane Rubber: Urethane Rubber 1
Impregnation and Surface Layer Material: Curing Material 3
Impregnation Time: 30 sec
Apical Surface Impregnation Depth (C): 10 μm
Surface Layer Thickness on Apical and Under Surfaces (E): 0.6 μm
(C)*(E): 6 $\mu m^2$
Blade Edge Abraded Cross-sectional Area: 90 $\mu m^2$
Poor Cleaning: 2 stripe poor cleaning
Abnormal Noise: None
Blade Surface Crack and Peeling: None
Apical surface was scooped and abraded Comparative Example 3-2

Base Urethane Rubber: Urethane Rubber 2
Impregnation and Surface Layer Material: Curing Material 7
Impregnation Time: 0 sec
Apical Surface Impregnation Depth (C): 0 μm
Surface Layer Thickness on Apical and Under Surfaces (E): 0.8 μm
(C)*(E): 0 $\mu m^2$
Blade Edge Abraded Cross-sectional Area: 120 $\mu m^2$
Poor Cleaning: 3 stripe poor cleaning
Abnormal Noise: Oscillation noise
Blade Surface Crack and Peeling: Observed Comparative Example 3-3

Base Urethane Rubber: Urethane Rubber 7
Impregnation and Surface Layer Material: Curing Material 1
Impregnation Time: 40 sec
Apical Surface Impregnation Depth (C): 20 μm
Surface Layer Thickness on Apical and Under Surfaces (E): 0 μm
(C)*(E): 0 $\mu m^2$
Blade Edge Abraded Cross-sectional Area: 150 $\mu m^2$
Poor Cleaning: 2. stripe poor cleaning
Abnormal Noise: None Comparative Example 3-4

Base Urethane Rubber: Urethane Rubber 3
Impregnation and Surface Layer Material: Curing Material 4
Impregnation Time: 90 sec
Apical Surface Impregnation Depth (C): 80 μm
Surface Layer Thickness on Apical and Under Surfaces (E): 1.5 μm
(C)*(E): 120 $\mu m^2$
Blade Edge Abraded Cross-sectional Area: 200 $\mu m^2$
Poor Cleaning: 3 stripe poor cleaning
Abnormal Noise: Oscillation noise
Blade Surface Crack and Peeling: None Comparative Example 3-5

Base Urethane Rubber: Urethane Rubber 4
(C)*(E): 0 $\mu m^2$
Blade Edge Abraded Cross-sectional Area: 80 $\mu m^2$
Poor Cleaning: 3 stripe poor cleaning
Abnormal Noise: None
Apical surface was scooped and abraded

TABLE 4

| | (A) | (B) | (C) | (E) | (C)*(E) | (F) | (H) | (I) | (J) | Others |
|---|---|---|---|---|---|---|---|---|---|---|
| Example 3-1 | 1 | 1 | 60 | 0.5 | 30 | 20 | None | None | None | |
| Example 3-2 | 4 | 3 | 40 | 0.3 | 12 | 30 | None | None | None | |
| Example 3-3 | 2 | 4 | 80 | 0.8 | 64 | 70 | None | None | None | |
| Example 3-4 | 1 | 9 | 100 | 1.0 | 100 | 80 | None | None | None | |
| Example 3-5 | 3 | 5 | 60 | 0.6 | 36 | 90 | None | None | None | |
| Example 3-6 | 4 | 1 | 80 | 1.0 | 80 | 50 | None | None | None | |
| Example 3-7 | 2 | 10 | 80 | 0.6 | 48 | 40 | None | None | None | |
| Comparative Example 3-1 | 1 | 3 | 10 | 0.6 | 6 | 90 | 2 stripe | None | None | Apical Surface Scooped Abraded |
| Comparative Example 3-2 | 2 | 7 | — | 0.8 | — | 120 | 3 stripe | Oscil-lation | Observed | |
| Comparative Example 3-3 | 7 | 1 | 20 | — | — | 150 | 2 stripe | None | — | |
| Comparative Example 3-4 | 3 | 4 | 80 | 1.5 | 120 | 200 | 3 stripe | Oscil-lation | None | |
| Comparative Example 3-5 | 4 | — | — | — | — | 80 | 3 stripe | None | — | Apical Surface Scooped Abraded |

Table 4 is a summary of verification experiment results of Examples 3-1 to 3-7 and Comparative Examples 3-1 to 3-5.

As Table 4 shows, in Comparative Example 3-1 in which a product of the impregnation depth from the apical surface 62*a* and the thickness of the surface layer 623 thereon is less than 10 $\mu m^2$, the apical surface was scooped and abraded. This is because the surface layer 623 and the impregnation could not make the edge line 62*c* of the cleaning blade stiff. In Comparative Example 3-4 in which a product of the impregnation depth from the apical surface 62*a* and the thickness of the surface layer 623 thereon is greater than 100 $\mu m^2$, the surface layer 623 and the impregnation made the edge line 62*c* of the cleaning blade too stiff, resulting in large abrasion of 200 $\mu m^2$ after production of 100,000 images.

Meanwhile, in Examples 3-1 to 3-7 in which a product of the impregnation depth from the apical surface 62*a* and the thickness of the surface layer 623 thereon is from 10 to 100 $\mu m^2$, the effects of the impregnation and the surface layer were respectively exerted. A synergetic effect thereof was exerted as well, and abrasion, poor cleaning and abnormal noise were prevented.

Having now fully described the invention, it will be apparent to one of ordinary skill in the art that many changes and modifications can be made thereto without departing from the spirit and scope of the invention as set forth therein.

What is claimed is:

1. A cleaning blade, comprising a strip-shaped elastic blade configured to contact the surface of a member to be cleaned, traveling on an edge line of the elastic blade, to remove a powder from the surface of the member to be cleaned, wherein the edge line of the elastic blade is impregnated with an ultraviolet curable resin comprising a fluorinated acrylic monomer, a surface layer harder than the elastic blade is formed on each of an under surface thereof, having the edge line as one line of the under surface and facing the member to be cleaned, and an apical surface thereof, having the edge line as one line of the apical surface and being parallel to a direction of the thickness thereof, and the apical surface is impregnated with the ultraviolet curable resin at a depth of from 50 to 150 μm and the under surface is impregnated with the ultraviolet curable resin at a depth of from 20 to 100 μm.

2. The cleaning blade of claim 1, wherein the apical surface has a Martens hardness larger than that of the under surface.

3. The cleaning blade of claim 1, wherein a product of an impregnated depth of the ultraviolet curable resin comprising a fluorinated acrylic monomer from the apical surface and a thickness of the surface layer thereon is from 10 to 100 $\mu m^2$.

4. The cleaning blade of claim 1, wherein the apical surface is wholly impregnated.

5. The cleaning blade of claim 1, wherein the surface layer has a thickness not greater than 1 μm.

6. The cleaning blade of claim 1, wherein the fluorinated acrylic monomer is an acrylate having a perfluoropolyether skeleton and two or more functional groups.

7. The cleaning blade of claim 1, wherein the ultraviolet curable resin is a mixture of an acrylate material having pentaerythritoltriacrylate having a functional group equivalent molecular weight not greater than 350 and 3 to 6 functional groups as a main skeleton and an acrylate material 1 having a functional group equivalent molecular weight of from 100 to 1,000 and 1 or 2 functional groups.

8. The cleaning blade of claim 1, wherein the surface layer is formed of the same ultraviolet curable resin.

9. The cleaning blade of claim 1, wherein the elastic blade is formed of a rubber comprising a urethane group.

10. The cleaning blade of claim 1, wherein the following relationship is satisfied for a predetermined time after the member to be cleaned is cleaned:

apical surface abraded width/under surface abraded width $<2/3$.

11. An image forming apparatus, comprising:

an image bearer;

a charger configured to charge the surface of the image bearer;

a latent image former configured to form an electrostatic latent image on the surface of the image bearer;

an image developer configured to develop the electrostatic latent image with a toner to form a toner image;

a transferer configured to transfer the toner image onto a transfer material; and a cleaner comprising a cleaning blade configured to contact the surface of the image bearer to remove the toner remaining untransferred thereon, wherein the cleaning blade is the cleaning blade according to claim 1.

12. A process cartridge detachable from image forming apparatus, comprising:

a photoreceptor; and the cleaning blade according to claim 1.

* * * * *